US005700369A

United States Patent [19]

Zhou et al.

[11] Patent Number: 5,700,369

[45] Date of Patent: Dec. 23, 1997

[54] PROCESS FOR ADSORBOAGGREGATIONAL FLOTATION OF CARLIN TYPE NATURAL GOLD ORE DRESSING

[75] Inventors: Zheng Zhou; Zailan Zou, both of Guangzhou, China

[73] Assignee: Guangzhou Institute of Geochemistry Chinese Academy of Sciences, Guangzhou, China

[21] Appl. No.: 783,012

[22] Filed: Jan. 14, 1997

[51] Int. Cl.[6] ..... B03D 1/02; B03D 1/01

[52] U.S. Cl. ..... 209/166; 209/167

[58] Field of Search ..... 209/166, 167

[56] References Cited

U.S. PATENT DOCUMENTS

| | | |
|---|---|---|
| 2,512,669 | 6/1950 | Morrow . |
| 4,853,114 | 8/1989 | Lewis . |
| 5,030,340 | 7/1991 | Panzer . |

FOREIGN PATENT DOCUMENTS

| | | |
|---|---|---|
| 85 1 09643 A | 4/1987 | China . |
| 86 1 01495 A | 6/1987 | China . |
| 86 1 01573 A | 6/1987 | China . |
| 86 1 05982 A | 4/1988 | China . |
| 1080567 A | 1/1994 | China . |

*Primary Examiner*—Thomas M. Lithgow

*Attorney, Agent, or Firm*—Armstrong, Westerman, Hattori, McLeland & Naughton

[57] ABSTRACT

A novel process for adsorptive aggregation and also floatation of Carling type gold ores, which goes far beyond the conventional floatation method. Said novel technological procedures comprise fine grinding as well as sluicing of raw ores and adding special floatation agents such as stripping agent, adsorptive aggregation agent as well as collecting agent and flocculant in the course of coarse screening and sweep screenings. The fine ore obtained using the present process is graded as 22 g/T with a recovery yield langer than 83%. Said process has a screening index high and stable, it is safe and reliable and can be effectively put into industrial production.

9 Claims, No Drawings

PROCESS FOR ADSORBOAGGREGATIONAL FLOTATION OF CARLIN TYPE NATURAL GOLD ORE DRESSING

DESCRIPTION

The present invention relates to the improvement of gold ore screening process.

The Carling type gold mine, i.e., the fine grain type gold mine, is a type of natural gold, which distributes in a supermicroscopic state in the sulfide mineral and the clay mineral, and contains a certain amount of arsenic and carbon and other harmful impurities. It is a gold mine typically not easy to be disposed both the screening enrichment and the smelting recovery, of which are rather diffcult. If this sort of gold mine employs conventional method to directly sinter-cyanide raw gold ores for extractlong of gold, it tums out to be difficult to be applied in production, because the raw gold ore is of no high grade, needing in general to be sintered twice to achieve homogeneity, and the fine grain gold is easy to be lost while being sintered etc. For the time being, the process being under research is the floatation-sintering-cyaniding process, the essentials of which are improving the grade of gold ore by means of gold ore floatation, and merely sintering and cyanizing the fine gold ore to obtain gold. This is a practical technological solution of high efficiency and low cost, the key of its success lies in the gold ore screening indices. Although a great many scientists and technicians have conducted a great number of experimental studies on the floatation method of Carling type mine natural gold ores, yet all of them fail to go beyond the scope of "conventional floatation", that is, using the approach to float the "visible natural gold" to solve the problem on floating the "invisible natural gold". At present, the floatation indices that the floatation experiments on Carling type mine natural gold ores can achieve read:while the grade of raw gold ore is 3.91 g/T, the grade of fine gold ore reaches about 9.18 g/T, the yield is about 37%, the fine gold ore recovery is about 87% and the grade of the ore dregs is 0.81 g/T, these are difficult to meet the requirement of industrial production.

The object of the present invention is to provide a novel floatation process which can greatly raise the indices of the fine ore grade, has a safe and reliable technology and a high and stable screening index, and is suitable for the use of low grade gold ore, low grade gold-containing dregs, especially Carling type mine natural gold ore to be practically and effecively used in production.

The technical solution of the present invention is a novel adsorption-aggregation-floatation process, the screening course of which comprises the following steps.

1. About 80% of the mineral ore is first finely ground to below 200 mesh;

2. The mineral ore after being ground is sluiced;

3. Then the sluiced mineral ore is sent to the floatation machine system for floataton comprising coarse screening and sweep screenings, in general one coarse screening and two sweep screenings. During the screenings,the following preparations shall be sequentially added there- into:

a. a sufficient amount of "stripping agent",a mixed aqueous solution of fluorosodium silicate, lactic acid, lead nitrate and acid, the compositions (weight percentage) of which is: 0.025~1 fluorosodium silicate, 0.03~1 lactic acid, 0.03~1.6 lead mitrate, 0.4~5 nitric acid, and the rest water;

b. a sufficient amount of "adsorptive aggregation agent," a mixed emulsified solution of ethtyl xanthine, coal oil, machine oil, turpentine oil and dodecylamine, the composition (weight percentage) of which is: 520 coal oil, 0.1~3 machine oil, 1~2 turpentine oil, 0.1~1 ethyl xanthine, 0.05~0.5 dodecylamine and the rest water;

c. a sufficiant areout of "xanthine collecting agent;"

d. a sufficient amount of flocculant.

The acid in the ingredients of the "stripping agent" is preferably sulfuric acid or nitric acid.

After one coares screening and two sweep screenings, the final fine ore and ore dregs can be obtained, The above-indicated technology is used, mainly based on the following floating features of the Carling type mine natural gold ore :(1) the sludge amount contained is large, mainly of clay mineral and carboneous substance; (2) the floating properties of the gold-bearing minral, i.e.pyrite, are very poor and difficult to be activated; (3) the floatability of another gold-bearing mineral, the clay ore, is nice; (4) the floating activity of the vein mineral ore is strong and difficult to be inhibited etc. Among the procedures, that above 80% raw ore is finely ground to smaller than 200 mesh is for the purpose of achieving a better floatation effect; that the ore is first sluiced before floatathion is for the purpose of sluicing those fine muddy dusts of average gold content between 0.3 and 0.5 g/T so as to reduce the use amounts of the preparations during the floatation, this is a critical step to raise the floatation indices. The sluice operation generally uses dedust hopper which is installed between the ore grinding machine and the floatation stir basin, wherein the sluiced amount is controlled by the magnitude of the up going water flow. The "stripping agent" and the "adsorptive aggregation agent" uniquely and creatively added during the floatation, are also important features of the present invention. The "stripping agent" is used for cleansing the surface of pyrite so as to increase its activity and so as to have the xanthine collecting agent later added capable of being fixedly attached, it can further remove the surface activity centers of the vein mineral ore so as to have the water film fixedly covering thereon. The "adsorptive aggregation agent" acts to absorptively accumulate the gold-containing minereal ore distributed in the ore pulp.

The preparations to be added during above-mentioned floatation course are determined by their corresponding use amounts, based on the different sources of the ore samples, the usual preparation additions (for each ton of mineral ore) during the coarse screening are: stripping agent 0.3~0.7 kg, adsorptive aggregation agent 0.6~1.0 kg, xanthine collecting agent 0.1~0.3 kg, flocculant 0.02~0.07 kg, and those during the sweep screening are: stripping agent 0.15~0.35 kg, adsorptive aggregation agent 0.3~0.5Skg, xanthine collecting agent 0.05~0.015 kg, and flocculant 0.01–0.03 kg.

The said "stripping agent" and the said "adsorptive aggregation agent" are special preparations to be added in the floatation system of the present invention. Usually, the "stripping agent" is prescribedly prepared according to the following method so as to achieve a better predetermined effect:

a. fluorosodium silicate solution A of a prescribed concentration range 0.1%~4.0%.

b. lactic acid solution B of a prescribed concentration range 0.12%~4.0%;

c. lead nitrate solution C of a prescribed concentration range 0.11%~5.4%;

d. acid solution D of a prescribed concentration range 1.5%~20%;

e. A and B are first mixed up, then C and D are mixed, finally A+B and C+D are mutually mixed up.

The adsorptive aggregation agent can be prescribed and prepared as follows:

a. ethyl xanthine and dodecylamine are dissolved in water to form aqueous solution E the composition (weight percentage)of which reads: 0.2~2 ethyl xanthine, 0.05~0.5 dodecylamine and the rest water;

b. machine oil, turpentine oil, dodecylamine and water are added into coal oil, and mixed up homogeneously, their composition (weight percentage) reads: coal oil 10~40, machine oil 0.2~6, turpentine oil 0.2~4, dodecylamine 0.05~0.5 and water the rest;

c. the mixed solution produced by step b is set static until it is clearly laminated, the main component of the lower layer solution is water which contains the impurities released from various components of the mixture solution. This portion of lower layer solution is removed, and water of a same weight as that of the lower layer solution removed is supplemented to form a new mixture solution F, and the action of this step is practically to remove therefrom the impurities contained in the various components of the mixture.

d. E and F are simultaneously added into the container to be emulsified, basically according to the ratio (weight) 1:1.

The present invention uses the mixture xanthine consisting of ethyl xanthine, butyl xanthine, and isopentyl xanthine as the "xanthine collecting agent", the effect of which is much better than that of the collecthing agent having but a single component, said mixture "xanthine colleching agent" can be mixedly prepared according to the following prescription (weight percentage): ethyl xanthine 20~40, butyl xanthine 20~40 and isopentyl xanthine 20~40.

The flocculant to be added into the floatation system can be a substance selected from the group consisting of polyacrylamide, dextrin and starch. The concentration of the flocculant to be added into the floatation system needs be adjusted to be 0.01~0.1%.

When the screening technology of the present invention is used for the floatation of Carling type mine material gold ore, the grade of the fine ore obtained is above 22 g/T, the recovery is larger than the grade index of the fine ore resulted from conventional screening technologies, further, the yield is nearly same, the screening indices of the entire technology are high and stable, all the preparations used therein are not toxic, giving rise to no environmental pollution, the procedures of said process are clear cut, easy to be handled, and of lower investment, can be effectively put into industrial production, and lead to significant economic benefits.

EMBODIMENT EXAMPLE I

The adsorptive aggregation and floatation is conducted, based on the following technological proceduses:

(1) the gold ores are roughly crushed and then machine ground to smaller than 200 mesh up to 85%;

(2) the raw ores after being ground are sluiced to remove the fine maddy dust of an average gold content smaller than 0.5 g/T;

(3) the gold ores after being sluiced are added into the floatation machine for their floatations, first one coarse screening and then two sweep screenings.

The following preparations are added thereinto during the coarse screening and the sweep screenings:

a. preparations additions during coarse screening: stripping agent 0.5 kg/T, adsorptive aggregation agent (emulgive) 0.8 kg/T, xanthine collecting agent 0.2 kg/T, polyacrylamide fiocculant 0.05 kg/T;

b. preparations additions during sweep screenings: stripping agent 0.25 kg/T, adsorptive aggregation agent (emulsive) 0.4 kg/T, xanthine collecting agent 0.1 kg/T, polyacrylamide fiocculant 0.02 kg/T.

Among them, the stripping agent is prescribecdlly prepared according to the following components (weight percentage): fiuorosodium silicate 0.5, lactic acid 0.5, lead nitrate 0.8, sulfuric acid 2~7 and the rest water. The prescription runs as follows: (1) fluorosodium silicate solution A of a concentration 2% is prepared prescribedly; (2) lactic acid solution B of a concentration 2% is prepared prescribedly; (3) lead nitrate solution C of a concentration concentration 3.2% is prepared prescribedly; (4) sulfuric acid solution D of a concentration 10.8% is prepared prescribedly; (5) A is mixed with B, then C is mixed with D, and finally A+B is mixed with C+D.

The composition of the adsorptive aggregation agent (weight percentage) reads: 11.7 coal oil, 1.0 machine oil, 0.6 turpentine oil, 0.5 ethyl xanthine, 0.1 dodecylamide and the rest water.

The prescription of the adsorptive aggregation agent runs as follows:

a. ethyl xanthine and dodecylamide are dissolved into water to form aqueous solution E, the composition (weight percentage) of said aqueous solution reads: 10 ethyl xanthine, 0.1 dodecylamine and the rest water;

b. machine oil, turpentine oil, dodecylamine and water are added into coal oil, and homogeneously mixed up, the composition (weight percentage) thereof is: 23.40 coal oil, 2 machine oil, 1.2 turpentine oil, 0.1 dodecylamine and the rest water;

c. the mixture solution produced by step b is set static until said solution is clearly laminated, the lower layer water containing impurities is removed and then water of same amount as that of removed lower layer solution is supplemented thereinto to obtain new mixture solution F;

d. E and F are simultaneously added into the container to be emulsified, basically according to the ratio 1:1 (weight percentage).

The xanthine collecting agent is formed by mixing ethyl xanthine, butyl xanthine and isopentyl xanthine according to the prescribed ratio 1:1:1.

The concentration of the polyacrylamide flocculant is adjusted to be 0.05%.

EMBODIMENT EXAMPLE II

The adsorptive aggregation and floatation technological procedures are same as those of Embodiment Example I, the preparations additions during the coarse screening and the sweep screenings are:

a. preparations addtions during coarse screening: stripping agent 0.3 kg/T, adsorptive aggregation agent (emulsive) 0.6 kg/T, xanthine collecting agent 0.1 kg/T, and dextrin flocculant 0.02 kg/T;

b. preparations additions during sweep screenings: stripping agent 0.15 kg/T, adsorptive aggregation agent (emulsive) 0.3 kg/T, collecting agent 0.05 kg/T and dextrin flocculant 0.01 kg/T.

Among them, the stripping agent is prescribedly prepared according to the following composition (weight percentage): 1.0 fluorosodium silicate, 1.0 lactic aid, 1.6 lead nitrate, 5.0 sulfuric acid and the rest water. The prescription thereof runs as follows: (1) 4.0% fluorosodium silicate solution A is prescribedly prepared; (2) 4.0% lactic acid solution B is prescribedly prepared; (3) 5.4% lead nitrate C is prescribdedly prepared; (4) 20% sulfuric acid solution D is prescribedly prepared; (5) A is mixed with B, then C is mixed with D and finally A+B is mixed with C+D.

The composition (weight percentage) of the adsorptive aggregation agent reads: coal oil 20, machine oil 3, turpentine oil 2, ethyl xanthine 1, dodecylamine 0.5 and water the rest.

The prescription of the adsorptive aggregation agent runs as follows:

a. ethyl xanthine and dodecylamine are dissolved in water to form aqueous solution E, the composition (weight percentage) of said aqueous solution reads: 2 ethyl xanthine, 0.5 dodecylamine and the rest water;

b. machine oil, turpentine oil, dodecylamine and water are sequentially added into coal oil and mixed up homogeneously, the composition thereof (weight percentage) reads: 40 coal oil, 6 machine oil, 4 turpentine oil, 0.5 dodecylamine and the rest water;

c. the mixture solution produced by step b is set static until said solution is clearly laminated, water of the lower layer containing impurities is removed to form new mixture solution F;

d. E and F are simultaneously added into a container to be emulsified according to the weight ratio 1:1.

The xanthine collecting agent is formed by mixing the followings (weight percentage): ethyl xanthine 20, butyl xanthine 40, isopentyl xanthine 40.

The concentration of the dextrin flocculant is adjusted to be 0.1%.

EMBODIMENT EXAMPLE III

The adsorptive aggregation and floatation technological procedures are same as those of Embodiment Example I, the preparations additions during the coarse screening and the sweep screenings read as follows:

a. preparations additions during coarse screening: stripping agent 0.7 kg/T, adsorptive aggregation agent (emulsive) 1.0 kg/T,xanthine collecting agent 0.3 kg/T, and starch flocculant 0.07 kg/T;

b.preparations additions during sweep screenings: stripping agent 0.35 kg/T,adsorptive aggregation agent (emulgive) 0.5 kg/T, xanthine collecting agent 0.15 kg/T, starch flocculant 0.03 kg/T.

Among them, the stripping agent is prescribedly prepared according to the following composition (weight percentage): 0.025 fluorosodium silicate, 0.03 lactic acid, 0.03 lead nitrate, 0.4 acid and the rest water. The prescription of the stripping agent runs as follows: (1) fluorosodium silicate A of a concentration 0.1% is prepared prescribedly; (2) lactic acid solution B of a concentration 0.12% is prepared prescribedly; (3) lead nitrate solution C of a concentration 0.1% is prepared prescribedly; (4) diluted acid solution D of a concentration 1.5% is prepared prescribedly; (5) A is first mixed with B, then C is mixed with D and finally A+B and C+D are mutually mixed up.

The compostion (weight percentage) of the adsorptive aggregation agent reads: 5 coal oil, 0.1 machine oil, 0.1 turpentine oil, 0.1 ethyl xanthine, 0.05 dodecylamine and the rest water. The prescription thereof runs as follows: a). ethyl xanthine and dodecylamine are dissolved in water to form aqueous solution E, the composition (weight percentage)of which reads: 0.2 ethyl xanthine, 0.05 dodecylamine and the rest water;b).first machine oil, turpentine oil, dodecylamine and water are added into coal oil, and homogeneously mixed up, with the composition thereof (weight percentage) being: 10 coal oil, 0.2 machine oil, 0.2 turpentine oil, 0.05 dodecylamine and the rest water; c).the mixted solution produced by step b is set static until it is clearly laminated, the lower layer solution thereof is removed and then water of same weight as that of the lower layer solution is supplemented thereinto to form new mixture solution F; d).E and F are simultaneously added into a container to be emulsified, basically according to the ratio(weight ratio) 1:1.

The xanthine collecting agent is prescribed by mixing the following components: ethyl xanthine 40, butyl xanthine 38, and isopentyl xanthine 22.

The concentration of the starch flocculant is adjusted to be 0.01%.

We claim as our invention:

1. A novel process for adsorptive aggregation and floatation of Carling type mine natural gold ores, comprising the following procedures:

(1) above 80% mineral ores are finely ground to smaller than 200 mesh;

(2) the mineral ores after being ground are first sluiced;

(3) then the sluiced ores are carried out a floatation which comprises coarse screening and sweep screenings, wherein the following preparations are sequentially added:

a. a stfficient amount of "the stripping agent" is added, the composition (weight percentage) of which is: 0.025~1 fluorosodium silicate, 0.03~1 lactic acid, 0.03~1.6 lead nitrate, 0.4~5 acid, and the rest water;

b. a sufficient amount of "the adsorptive aggregation agent" wherein the composition (weight percentage) is: 5~20 coal oil, 0. 1~3 machine oil, 0.1~2 turpentine oil, 0.1~1 ethyl xanthine, 0.05~0.5 dodecylamine and the rest water;

c. a sufficient amount of "xanthine collecting agent";

d. a sufficient amount of "flocculant".

2. The process of chaim 1 wherein the floatation comprises firstly one coarse screening and subsequently two sweep screenings.

3. The process of claim 1 or claim 2 wherein the additions of the preparations for each ton of mineral ores in the coarse screening of said floatation are: stripping agent 0.3~0.7 kg, adsorptive aggregation agent 0.6~1.0 kg, xanthine collecting agent 0.1~0.3 kg, flocculant 0.02~0.07 kg; and the additions of the preparations for each ton of mineral ores in the sweep screening are: stripping agent 0.15~0.35 kg, adsorptive aggregation agent 0.3~0.5 kg, xanthine collecting agent 0.05~0.15 kg, flocculant 0.01~0.03 kg.

4. The process of claim 1 wherein the said "stripping agent" is prescribeally prepared as follows:

a. fluorosodium silicate solution A of a prescribed concentration range of 0.1~4.0%;

b. lactic acid solution B of a prescribed concentration range of 0.12~4.0%;

c. lead nitrate solution C of a prescribed concentration range of 0.11~5.4%;

d. acid solution D of a prescribed concentration range of 1.5%~20%;

e. A is first mixed with B, then C is mixed with D, and finally A+B is mixed with C+D.

5. The process of claim 1 or 4 wherein the acid in the ingredients of the "stripping agent" is sulfuric acid or nitric acid.

6. The of claim 1 wherein the said "adsorptive aggregation agent" is prescribedly prepared according to the following procedures:

a. ethyl xanthine and dodecylamine are dissolved in water to form the aqueous solution E, the composition (weight percentage) of which is: 0.2~2 acetyl xanthine, 0.05~0.5 dodecylamine and the rest water;

b. machine oil, turpentine oil, dodecylamine and water are added into coal oil and mixed up homogeneously, the composition thereof: coal oil 10–40, machine oil 0.2~6, turpentine oil 0.2~4, dodecylamine 0.05~0.5 and water the rest;

c. the mixture solution produced by step b is set static until it is clearly delaminated, then the lower layer solution is removed and water of same weight as that of lower layer solution is supplemented therein to form a new mixture solution F;

d. E and F are simultaneously added into a container, basically according to the ratio (weight) of 1:1 to be emulsified.

7. The process of claim 1 wherein the said "xanthine collecting agent" is a xanthine mixture, consisting of ethyl xanthine, butyl xanthine, and isopentyl xanthine, the composition thereof (weight percentage): ethyl xanthine 20~40, butyl xanthine 20~40, and isopentyl xanthine 20~40.

8. The process of claim 1 wherein the flocculant is polyacrylamide, dextrin or starch.

9. The process of claim 1 wherein the concentration of said flocculant is 0.01~0.1%.

* * * * *